US009057588B1

(12) United States Patent
Simpson

(10) Patent No.: US 9,057,588 B1
(45) Date of Patent: Jun. 16, 2015

(54) PORTABLE REMOTE-CONTROLLED TARGET

(71) Applicant: Randy Simpson, Dowagiac, MI (US)

(72) Inventor: Randy Simpson, Dowagiac, MI (US)

( * ) Notice: Subject to any disclaimer, the term of this patent is extended or adjusted under 35 U.S.C. 154(b) by 143 days.

(21) Appl. No.: 13/900,179

(22) Filed: May 22, 2013

(51) Int. Cl.
*F41J 1/10* (2006.01)

(52) U.S. Cl.
CPC ..... *F41J 1/10* (2013.01)

(58) Field of Classification Search
USPC ..... 273/403–410, 390–392, 359, 366–370
See application file for complete search history.

(56) References Cited

U.S. PATENT DOCUMENTS

| | | | | | |
|---|---|---|---|---|---|
| 398,186 | A * | 2/1889 | Rehfuss | 273/404 |
| 840,610 | A * | 1/1907 | Easdale | 273/404 |
| 1,928,768 | A * | 10/1933 | Sell et al. | 273/409 |
| 1,981,293 | A * | 11/1934 | Varrelman | 273/404 |
| 2,034,839 | A * | 3/1936 | Sheffield | 273/382 |
| 2,048,155 | A * | 7/1936 | Armantrout | 273/407 |
| 2,294,730 | A * | 9/1942 | Eggers | 324/178 |
| 3,519,272 | A * | 7/1970 | De Vogelaere | 273/404 |
| 4,247,116 | A * | 1/1981 | McQuary | 273/394 |
| 4,317,572 | A * | 3/1982 | Iseli | 273/406 |
| 4,491,328 | A * | 1/1985 | Meyer | 273/403 |
| 4,523,761 | A * | 6/1985 | Huscher | 273/371 |
| 4,548,414 | A * | 10/1985 | Denis | 273/367 |
| 4,583,744 | A * | 4/1986 | Tolliver et al. | 273/404 |
| 5,169,157 | A * | 12/1992 | Salmon | 273/407 |
| 5,829,753 | A * | 11/1998 | Wiser | 273/407 |
| 6,257,584 | B1 * | 7/2001 | Nasuti | 273/407 |
| 6,543,778 | B2 * | 4/2003 | Baker | 273/407 |
| 7,374,173 | B2 * | 5/2008 | Nasuti | 273/407 |
| 8,141,878 | B2 * | 3/2012 | Kuyl | 273/403 |
| 2008/0211190 | A1 * | 9/2008 | Smith | 273/407 |
| 2009/0026708 | A1 * | 1/2009 | Sitton | 273/403 |
| 2013/0228975 | A1 * | 9/2013 | Mason, III | 273/406 |

* cited by examiner

*Primary Examiner* — Mark Graham
(74) *Attorney, Agent, or Firm* — Botkin & Hall, LLP

(57) ABSTRACT

A portable remote controlled target assembly includes a frame carried on a base. The frame includes a first arm and a second arm. A sheath is carried on the first arm, a roller is carried on the second arm, and a sheet spans the sheath and the roller. The sheet includes a target. The sheet is advanced between the sheath and the roller by a motor which rotates the roller. The motor is remote control operated to allow new targets to be displayed while a user is remotely positioned during target practice.

16 Claims, 3 Drawing Sheets

60
64
82
58
66
66
66
4.
4.
72
68
30
14
28
46
40
52
78
52
26
50
24
22
44
90
92
52
52
86
36
48
10
42
84
38
16
12

PORTABLE REMOTE-CONTROLLED TARGET

BACKGROUND OF THE INVENTION

Target shooting is a popular sport and past time. Target shooting generally involves firing a weapon, such as a firearm or other projectile, at a target. Following repeated use, the target generally must be replaced with a clean target. Replacing the target is generally accomplished in one of two ways, first a user must approach the target and manually replace the target, or second, the target is mechanically moved toward the firing area, whereby the user can replace the target.

Where the user must approach the target, all other shooters must hold fire during replacement of the target, which can be inconvenient for the other shooters. Further, some shooters with disabilities may not be able to approach a target.

Mechanically moved targets are typically on a pulley system or similar apparatus that carries the target to the shooter to allow the target to be replaced without other shooters having to interrupt their shooting. Mechanically moved targets are expensive to build, and are impractical for anything except close-range shooting.

An improved target system is desired.

SUMMARY OF THE INVENTION

The present disclosure describes a remote-controlled target assembly, suitable for target practice with firearms or other projectiles. The target assembly of the present disclosure is disassemblable for transport and storing. The target of the present disclosure is capable of remote operation, such that the target can be replaced without having a user approaching the target and without having to advance the target to the user.

The present disclosure describes a target assembly supported on a base and having a frame extending above the base. The frame includes a pair of arms spaced apart from one another, the arms supporting a target. The target extends between a pair of rollers, with one of the rollers connected to a motor, with the motor remote-control activated. When activated, the motor rotates one of the rollers causing the target to be wound around the roller, thereby advancing the roll and providing a new target.

Once disassembled, the target assembly folds flat for convenient storage, such as for transportation.

BRIEF DESCRIPTION OF THE DRAWINGS

A preferred embodiment of this invention has been chosen wherein.

DESCRIPTION OF THE PREFERRED EMBODIMENT

The present disclosure describes a target assembly 10 which is formed having a base 12 and a frame 14. The target assembly 10 is a portable target suitable for target practice. One of the difficulties with target practice is the need to regularly change or replace targets. The target assembly 10 is remote-controlled to allow new targets to be provided without a user having to be near the target assembly. The target assembly 10 is disassemblable for portability and storage.

Figure 1:
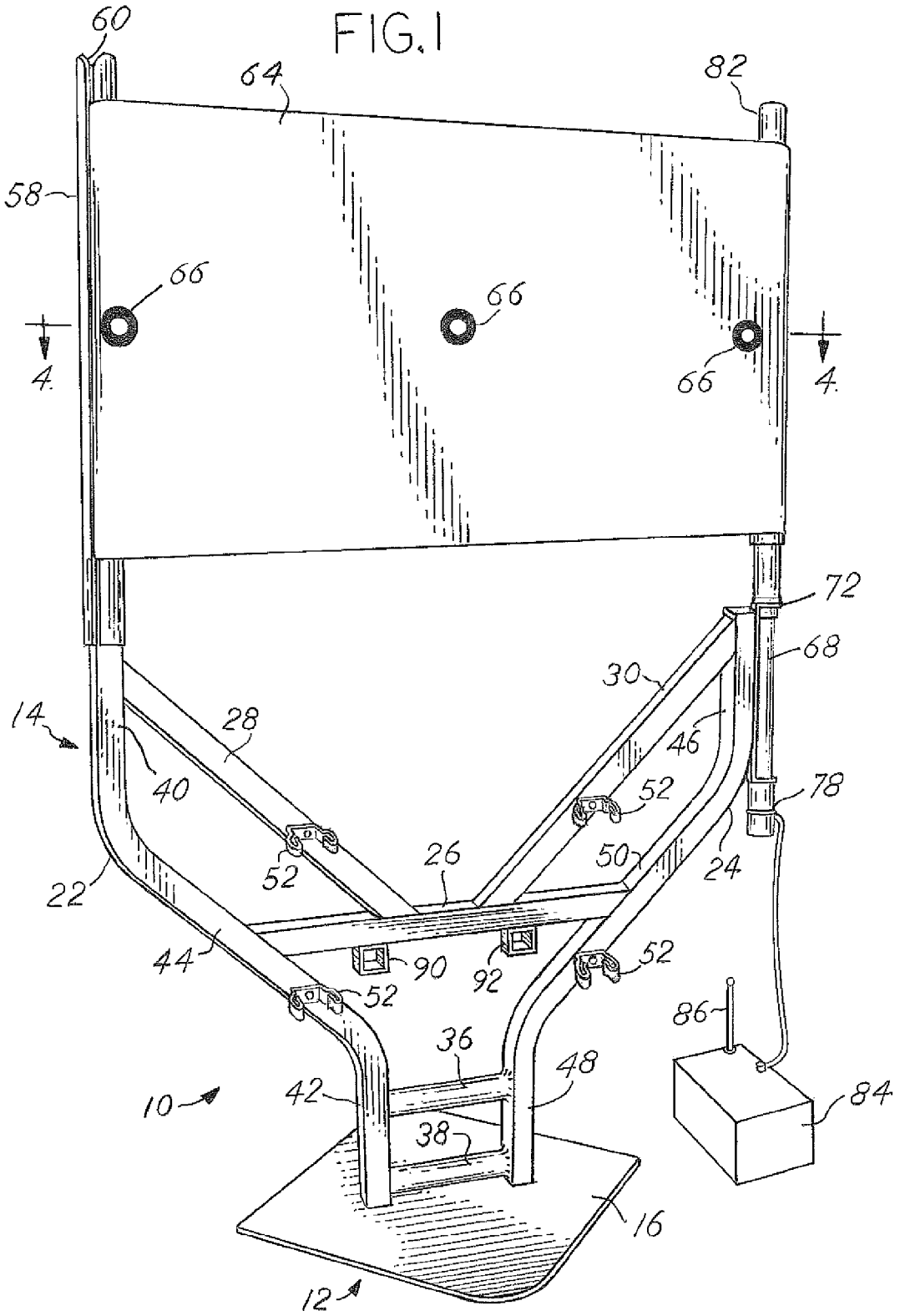
FIG. 1 is a perspective view of the target assembly of the present disclosure.
Figure 2:
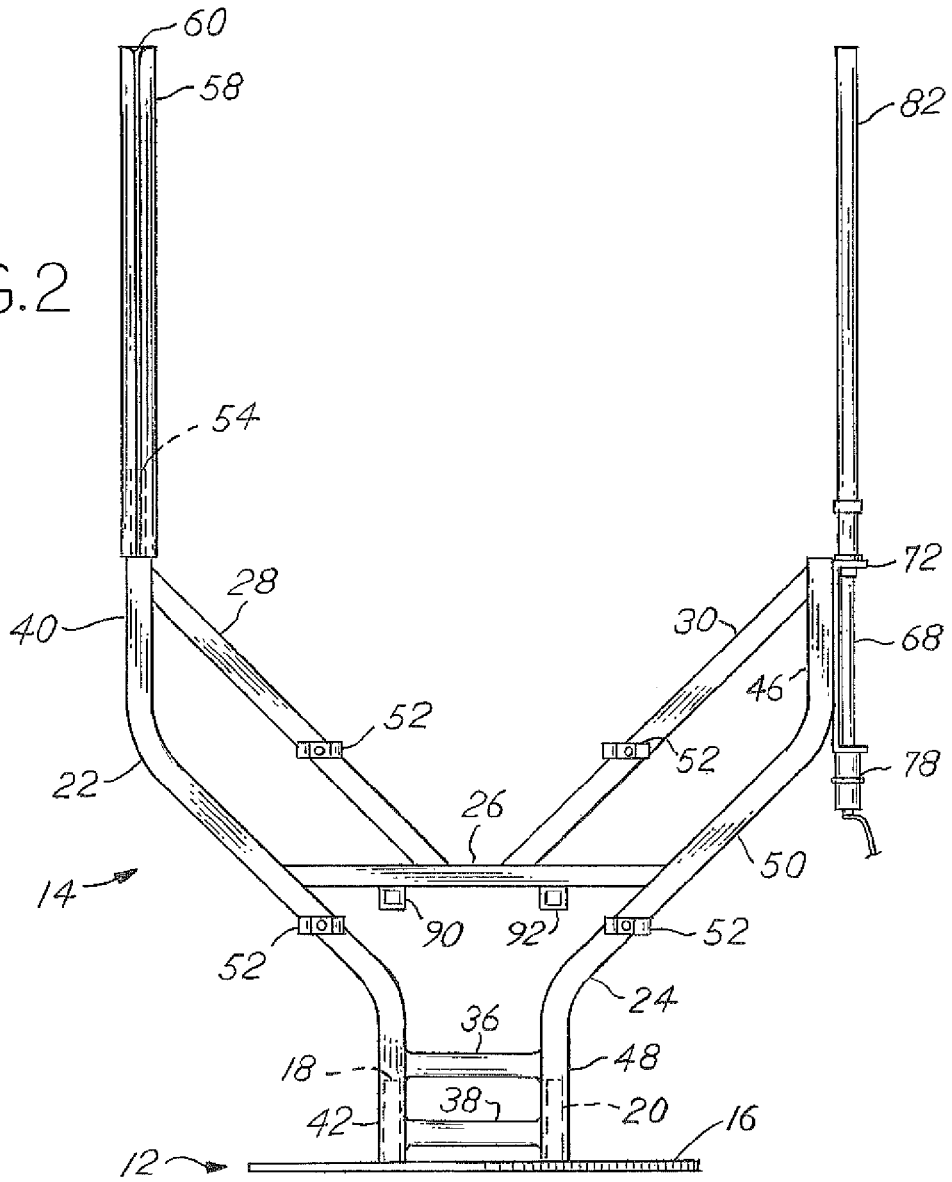
FIG. 2 is a front view of the target assembly of FIG. 1.
Figure 3:
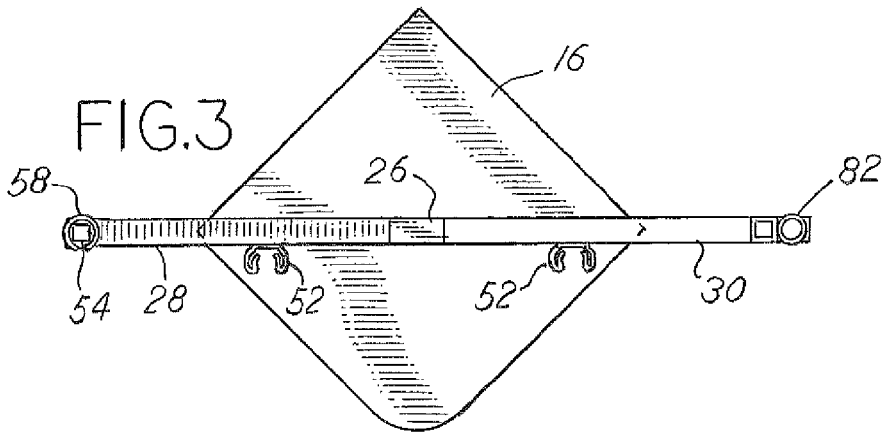
FIG. 3 is a top view of the target assembly of FIG. 1.
Figure 4:
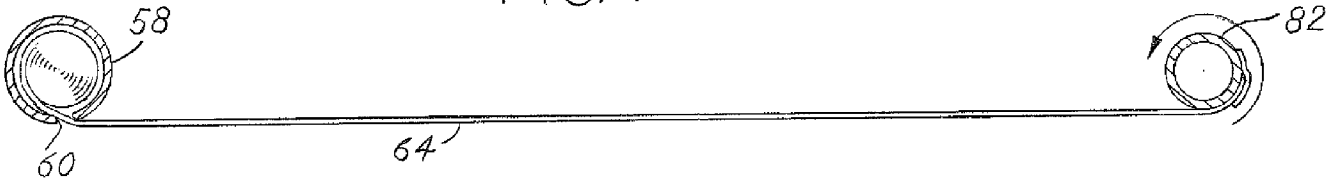
FIG. 4 is a top view of the target assembly of FIG. 1 and showing detail of the rollers.

Referring now to FIGS. 1 and 4, the base 12 of the target assembly 10 is a generally flat plate 16 having a first post 18 and a second post 20 extending from the upper face of the plate 16. The plate 16 is preferably formed from a sufficiently heavy and durable material to hold the target assembly 10 in an upright position.

The frame 14 is formed having a first arm 22 and a second arm 24 as illustrated in FIG. 1. The first arm 22 and second arm 24 are separated by a crossbar 26 and a first brace 28 and a second brace 30. The first arm 22 and second arm 24 are preferably hollow tubular members. The first arm 22 includes an opening 32 at the lower end thereof which accepts the first post 18. Similarly, the second arm 24 includes an opening 34 at the lower end thereof which accepts the second post 20. The first post 18 preferably is shaped to form a complimentary fit inside the first arm 22, such as a square cross-section as shown in FIG. 4. Similarly, the second post 20 preferably is shaped to form a complimentary fit inside the second arm 24 at the opening 34.

The first arm 22 and the second arm 24 of the frame 14 are joined together by a series of crossbars 26, 36, 38. Crossbars 36 and 38 are located near the base 12 and are oriented parallel one another and are joined perpendicularly to both first arm 22 and second arm 24. Crossbars 36 and 38 are preferably tubular members and provide strength and rigidity to the frame 14.

The first arm 22 is generally s-shaped with an upper portion 40 and a lower portion 42 which, when the frame 14 is mounted on the base 12, are oriented generally perpendicular to the base 12 and are oriented generally parallel with one another. The lower portion 42 is joined to the upper portion 40 by a spanning portion 44, wherein the spanning portion 44 is angled relative the upper portion 40 and the lower portion 44. The second arm 24 is a mirror-image of the first arm 22 with an upper portion 46, a lower portion 28 and a spanning portion 50. The crossbars 36 and 38 extend between the respective lower portions 42, 48. The crossbar 26 extends between the respective spanning portions 44, 50. The first brace 28 extends between the cross bar 26 and the upper portion 40. The second brace 30 extends between the cross bar 26 and the upper portion 46. It is contemplated that other crossbar and brace configurations are possible to serve the purpose of bracing the first arm 22 and the second arm 24. One or more brackets 52 are carried on the frame 14.

Figure 5:
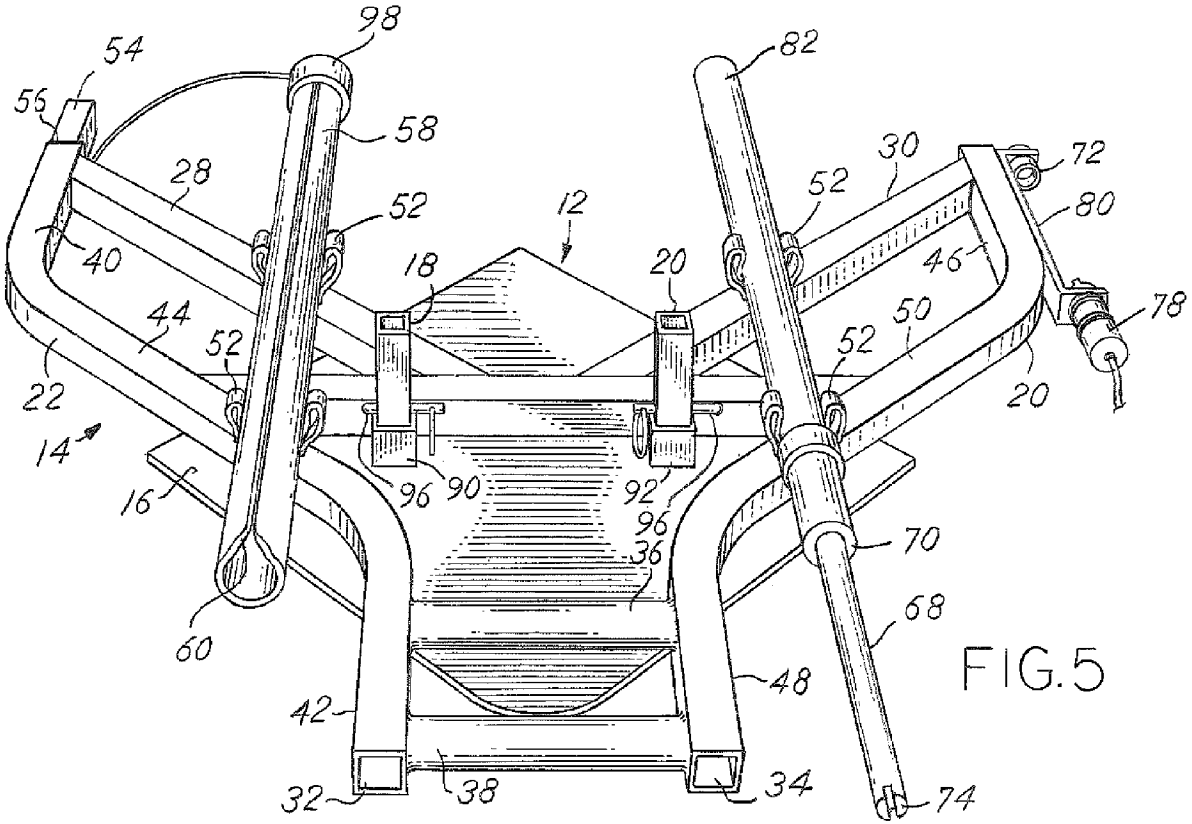
FIG. 5 is a perspective view of the target assembly of FIG. 1 as disassembled.

Referring now to FIG. 5, the first arm 22 includes a post 54 which extends from the end of the arm 22 opposite the base 12. The post meets the first arm 22 at a shoulder 56, the shoulder 56 forming a stepped change in outer perimeter dimension between the first arm 22 and the post 54.

Target assembly 10 also includes a sheath 58, which is carried on the post 54 as shown in FIG. 1. The sheath 58 is preferably cylindirical having a longitudinal slit 60 formed through the wall of the sheath 58 and extending the length thereof. The sheath 58 is mountable on the post 54, with the post nesting within one end of the sheath 58 and the sheath 58 abutting the shoulder 56. A roll 62 is carried in the interior of the sheath 58, the roll 62 having a sheet 64 wrapped around thereof. The sheet 64 is paper or other thin material suitable for having a target 66 displayed on the sheet and suitable for being rolled around the roll 62. Sheet 64 passes through the slit 60, such that the sheet 64 is unrollable from the roll 62 by advancing the sheet 64 out through the slit 60. One end of the sheet 64 is attached to a roller 82 which is mounted on the second arm 24.

The roller 82 is a generally cylindrical rod which includes an arm 68 extending from one end of the roller 82. The arm 68 meets the roller 82 at a shoulder 70, the shoulder 70 forming a stepped diameter change between the roller 82 and the arm 68. Shoulder 70 is seated on a guide 72 which is adjacent the end of the second arm 24. The guide 72 includes an aperture which circumscribes the arm 68. The arm 68 includes a keyed terminus 74 which is shaped to mate with a keyed seat 76 (not shown) which is formed as part of a motor 78. A bracket 80 is fastened to the second arm 24. The bracket carries the guide 72 at one end and the motor 78 at the other end, thereby mounting the guide 72 and the motor 28 to the frame 14.

The motor 78 includes an opening for accessing the keyed seat 76 (not shown). The keyed terminus 74 is sized to be seated against the keyed seat 76 (not shown) such that when the motor 78 rotates, the arm 68 in turn rotates. The motor 78 is in electrical communication with a receiver 84. The receiver 84 includes an antenna 86 for receiving signals from a remote control 88. The receiver 84 also serves as a power supply for the motor 78. The receiver 84 translates the signals received from the remote control 88 into commands for operating the motor 78.

A leading edge of the sheet 64 is attached to the roller 82, such as by tape or adhesive. When thusly joined, when the motor 78 is activated, the roller 82 rotates and the sheet 64 is rolled around the roller while the sheet 64 is drawn out of the sheath 58 through the slit 60. In this way, the sheet 64 moves from the sheath 58 to the roller 82, causing the target 66 to move likewise. As such, when a user needs a new target 66, the user uses the remote control 88 to send a signal to the receiver 84 which relays a signal to the motor 78 which rotates the roller 82 advancing a fresh target 66.

The target assembly 10 is disassemblable, as shown in FIG. 5 for ease of transportation and storage. When disassembled, the sheath 58 is clipped to one or more of the brackets 52 and the roller is clipped to one or more other brackets 52. A first eyelet 92 and a second eyelet 94 are formed as part of the frame 14, preferably attached to the crossbar 26. When disassembled, the first post 18 is threaded through the first eyelet 92 and the second post 20 is threaded through the second eyelet 94. The frame 14 is held to the base 12 by a cotter pin 96, preferably the cotter pin 96 is held by an aperture passing through one of posts 18, 20 and prevents the corresponding eyelet 90, 92 from being drawn away from the base 12 while the cotter pin 96 is in the aperture. When disassembled, a cap 98 is placed over one end of the sheath 58 to protect and secure the roll 62.

One advantage of the target assembly 10 described herein is that since the target 66 is printed on a thin sheet 64, the bullet or other projectile fired at the target will readily pass through the sheet 64 on contact. Since the bullet will readily pass through the sheet 64, the kinetic energy of the bullet will not be transferred to the target assembly 10. As such, the target assembly 10 will be suitable for all types of guns and ammunitions since the assembly 10 will not absorb the force of the projectile. This is an improvement over previous targets assemblies which include a backing which collects or slows the ammunition.

The slit 60 of the sheath 58 is preferably oriented facing normal to, or away from, the roller 82. By orienting the slit 60 away from the roller 82, the sheet 64 is forced into contact with an edge of the slit 60 and a portion of the face of the sheath 58, which adds some friction to the sheet 64, which helps to hold the sheet 64 in tension so that the sheet remains taut during use.

The sheet 64 is wrapped around a portion of the sheath 58 in such a way that the sheet 64 faces the user. Similarly, the sheet 64 is wrapped around the roller 82 in a way that the sheet 64 faces the user. As shown in FIG. 1, the sheet 64 includes a plurality of targets 66 printed on the sheet 64 at intervals. By wrapping the sheet 64 around the side of the sheath 58 and the roller 82 which faces the user, it is more likely that the targets 66 will be in view of the user.

The brackets 52 are preferably designed to affirmatively grasp objects. As shown in FIG. 1, the brackets 52 include a pair of spaced apart fingers which bias toward each other such that when an object, such as roller 82 or sheath 58, is placed between the fingers, the fingers will resistively grasp the object, thereby retaining the object to the frame 14.

The roller 82 and the sheath 60 are preferably oriented vertically relative the base 12. In this way, the sheet 64 extends horizontally between the sheath 60 and the roller 82. By mounting the roller 82 and the sheath 60 in a vertical position, only gravity is needed to hold these members in place, no additional fasteners are needed which simplifies assembly and disassembly of the target assembly 10.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A target assembly, for use as a shooting target, comprising:

a base having a first post and a second post;

a frame having a first arm supported on said base at said first post and a second arm supported on said base at said second post;

a sheath supported on said first arm, said sheath having a slit; said sheath carrying a rolled sheet;

a roller supported on said second arm; said sheet extending from said sheath through said slit to said roller;

a motor suitable for rotating said roller;

a receiver in electrical communication with said motor, said receiver suitable for receiving a remote signal;

a target disposed on said sheet.

2. The target assembly of claim 1, wherein said slit is oriented away from said roller.

3. The target assembly of claim 1, and an assembled position defined by said first arm removably supported on said base at said first post, said second arm removably supported on said base at said second post, said sheath removably supported on said first arm, said roller removably supported on said second arm.

4. The target assembly of claim 3, and a first eyelet and a second eyelet disposed on a crossbar extending between said first arm and said second arm.

5. The target assembly of claim 4, and a first bracket carried on said frame and a second bracket carried on said frame.

6. The target assembly of claim 5, and a disassembled position defined by said first post received in said first eyelet, said second post received in said second eyelet, said first bracket removably carrying said sheath, said second bracket removably carrying said roller.

7. A target assembly, for use as a shooting target, comprising:

a base having a first post and a second post;

a frame having a first arm and a second arm;

a sheath having a slit;

a roller;

a first eyelet and a second eyelet joined to said frame;

a first bracket and a second bracket joined to said frame;

an assembled position defined by said first arm removably supported on said base at said first post, said second arm removably supported on said base at said second post, said sheath removably supported on said first arm, said roller removably supported on said second arm;

a disassembled position defined by said first post received in said first eyelet, said second post received in said second eyelet, said first bracket removably carrying said sheath, said second bracket removably carrying said roller.

8. The target assembly of claim 7, wherein said slit is oriented away from said roller.

9. A target assembly, for use as a shooting target, comprising:

a vertically oriented roller having a sheet affixed thereto;

a plurality of targets displayed on said sheet;

a motor connected to said roller;

a receiver in electrical communication with said motor;

a remote control in communication with said receiver, whereby a signal transmitted from said remote control is relayed by said receiver to said motor to rotate said roller, thereby winding said sheet around said roller;

a sheath carrying said sheet, wherein rotation of said motor advances said sheet from said sheath to said roller, said sheath having a slit extending the longitudinal length of said sheath, said sheet passing through said slit, said slit oriented away from said roller, said sheath is slideably carried on a frame post which is disposed at the upper end of a frame member of said target assembly.

10. The target assembly of claim 9, wherein said frame member is supported on a base post which extends from a base.

11. The target assembly of claim 10, and an assembled position defined by said frame member supported on said base at said base post, said sheath removably supported on said frame post, said roller removably supported on said frame member.

12. The target assembly of claim 11, and a disassembled position defined by said base post received in an eyelet, a first bracket removably carrying said sheath, a second bracket removably carrying said roller.

13. The target assembly of claim 10, wherein said frame member is defined by a first arm and a second arm connected by a crossbar.

14. The target assembly of claim 13, wherein said frame post is disposed at one end of said first arm.

15. The target assembly of claim 13, wherein said eyelet is disposed on said crossbar.

16. The target assembly of claim 13, wherein said roller is mounted to said second arm.

* * * * *